United States Patent [19]

Laing

[11] Patent Number: 4,462,752

[45] Date of Patent: Jul. 31, 1984

[54] IN-LINE CENTRIFUGAL PUMP

[76] Inventor: Karsten Laing, Kaiserallee 51, D 7500 Karlsruhe, Fed. Rep. of Germany

[21] Appl. No.: 397,100

[22] Filed: Jul. 12, 1982

[30] Foreign Application Priority Data

Jul. 17, 1981 [DE] Fed. Rep. of Germany ..... 3128305

[51] Int. Cl.[3] ..... F04D 29/40

[52] U.S. Cl. ..... 415/219 B; 415/219 C; 415/199.2; 417/420; 417/423 R

[58] Field of Search ..... 417/420, 423, 424; 415/206, 219 A, 219 B, 219 C, 213 B, 122 R, 199 A, 168; 137/614.2

[56] References Cited

U.S. PATENT DOCUMENTS

| | | | |
|---|---|---|---|
| 1,644,129 | 10/1927 | Hollander | 415/199.1 |
| 3,485,371 | 12/1969 | Costantini | 137/614.2 |
| 3,771,910 | 11/1973 | Laing | 417/420 |
| 3,877,845 | 4/1975 | Green et al. | 417/424 |
| 4,036,565 | 7/1977 | Becker | 417/420 |
| 4,043,706 | 8/1977 | Walker | 417/420 |
| 4,352,646 | 10/1982 | Laing | 417/420 |

*Primary Examiner*—Stephen Marcus
*Assistant Examiner*—John Kwon
*Attorney, Agent, or Firm*—Pennie & Edmonds

[57] ABSTRACT

Shaftless centrifugal pumps have particularly advantageous running characteristics when installed vertically. But in order to make it possible for the delivery stream also to run vertically, the pipe connectors form bends, the ends of which can be integrated into a vertical pipeline.

1 Claim, 3 Drawing Figures

Fig. 1a
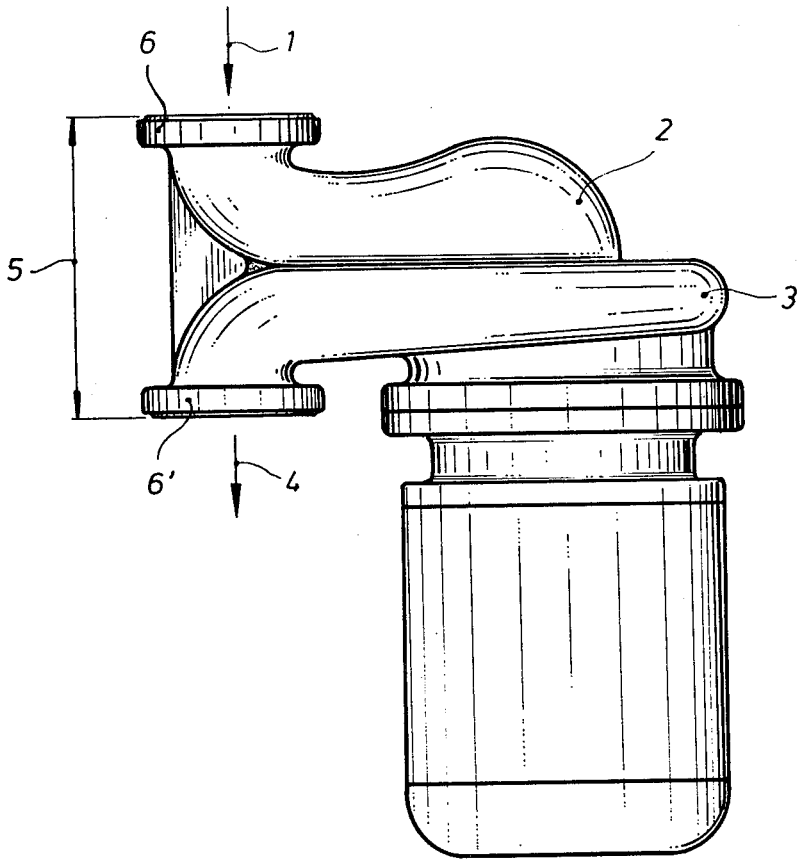
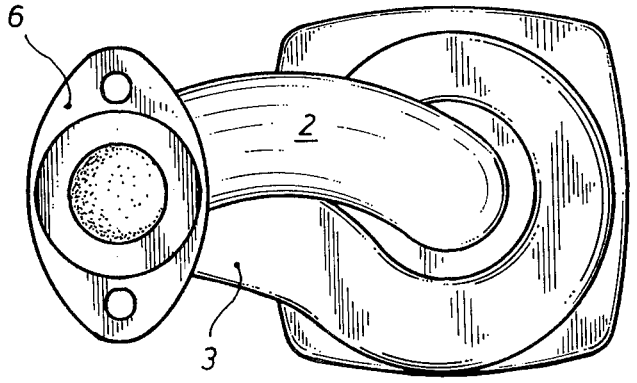
Fig. 1b

IN-LINE CENTRIFUGAL PUMP

FIELD OF THE INVENTION

The invention relates to centrifugal pumps in which the inlet and outlet openings are located opposite to one another.

BACKGROUND OF THE INVENTION

The simplest types of centrifugal pump construction have an inlet opening at the rotor suction opening and thus on the projected axis of the pump, whilst the outlet connector leaves the spiral housing tangentially. This arrangement leads not only to a right-angle deflection of the delivery stream but also to an offset between the inlet and outlet lines with respect to one another. A modified design is formed by spiral housings in which the inlet and the outlet lines are located in the same plane in which the axis of the pump is also located. In particular in the case of heating pumps, in-line embodiments are customary in which the inlet and outlet connectors are located opposite to one another and extend perpendicularly to the pump axis. The disadvantage of this embodiment lies in the fact that the distance between the connectors is comparatively great.

The centrifugal pumps with sealed shafts and split-cage motor pumps are joined by a third variant, centrifugal pumps which are driven through a pole ring which is hermetically isolated via a spherical isolating wall from the drive device, a stator or a circulating magnetic ring. The rotors of such pumps no longer have any shafts but form a unit with a pole ring with a spherical surface and are supported only by a sphere and a spherical pan. These supports are particularly well suited for pumps having a vertical axis since the supporting bearing of the whole periphery is then uniformly loaded.

DESCRIPTION OF THE INVENTION

The invention relates to in-line pumps in which the axes of the inlet and outlet connectors and of the pump rotor are located in one plane and run parallel with respect to one another. This arrangement makes it possible to have pumps with extremely short mounting dimensions between the inlet and outlet connectors and at the same time this principle makes it possible to arrange the axis of the pump vertically in the case of heating pumps in which the delivery stream runs vertically as a rule.

BRIEF DESCRIPTION OF THE DRAWINGS

The invention will be described with the aid of figures, in which:

FIG. 1*a* is a front view of a pump constructed according to the invention in which the delivery stream is directed downwardly;

FIG. 1*b* is a plan view of the pump of FIG. 1*a;* and,

DESCRIPTION OF THE PREFERRED MODES

Figure 2:
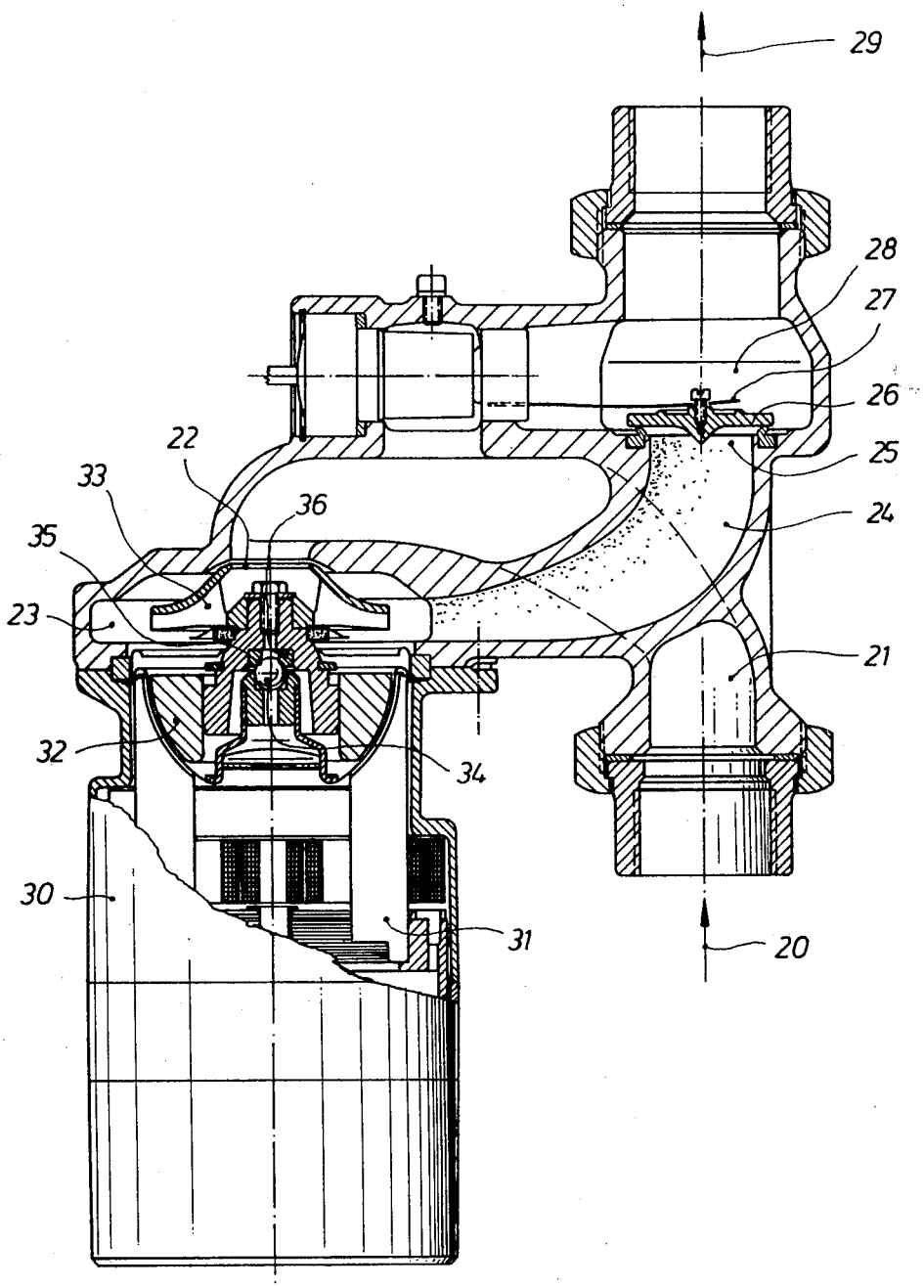
FIG. 2 is a partial sectional view of a pump constructed according to the invention in which the delivery stream is directed upwardly.

FIG. 1*a* represents the view of a pump according to the invention in which the delivery stream enters in accordance with the arrow (1), enters the rotor through the intake elbow (2) and leaves the pump again through the spiral housing (3) in accordance with the arrow (4). The arrangement according to the invention makes it possible to select the distance (5) between the inlet flange (6) and the outlet flange (6') to be extremely small.

FIG. 2*a* shows a pump according to the invention with a ball motor shown in section. In this pump, the inlet stream (20), which leads via the duct (21) into the rotor mouth (22), crosses the outlet stream which leaves the spiral housing (23) through the outlet line (24). The delivery stream is then conducted through a valve opening (25) which is kept closed by a valve plate (26) which is hinged at a spring (27). The outlet line (28) is expanded in the area of the valve plate. The delivery stream leaves the pump in accordance with the arrow (29). Since the motor (30) is arranged vertically and its stator (31) points downwards, the weight equilibrium, which is otherwise necessary for ball motors, between the pole ring area (32) and the bladed wheel or impellar (33), relative to the support area between the bearing ball (34) and the bearing pan (36), is not required. In addition, the bearing ball (34) is in contact with the bearing pan (36) along the whole periphery (35) which makes it possible to have a practically wear-free operation.

I claim:

1. A centrifugal pump adapted for use in vertically aligned piping where said pump has a housing, an impeller in said housing rotatable about a vertical axis of rotation and forming with said housing an inlet area and an outlet area, an inlet opening in said housing adjacent the top thereof communicating in one direction with said inlet area and in an opposite direction by an inlet line to an inlet flange, and an outlet opening in said housing adjacent the top thereof communicating in one direction with said outlet area and in an opposite direction by an outlet line to an outlet flange; characterized in that said inlet flange and said outlet flange are vertically aligned in a plane extending parallel to said axis of rotation with said inlet flange being below said outlet flange and are adapted to connect with vertically aligned piping and where said inlet line crosses said outlet line.

* * * * *